US010022773B2

(12) United States Patent
Rouns et al.

(10) Patent No.: US 10,022,773 B2
(45) Date of Patent: Jul. 17, 2018

(54) ALUMINUM SHEET WITH ENHANCED FORMABILITY AND AN ALUMINUM CONTAINER MADE FROM ALUMINUM SHEET

(71) Applicant: Alcoa USA Corp., Pittsburgh, PA (US)

(72) Inventors: Thomas N. Rouns, Pittsurgh, PA (US); David J. McNeish, Greensburg, PA (US); Jean F. Capps, Owensboro, KY (US); Christopher R. Miller, Newburgh, IN (US)

(73) Assignee: Alcoa USA Corp., Pittsburgh, PA (US)

( * ) Notice: Subject to any disclaimer, the term of this patent is extended or adjusted under 35 U.S.C. 154(b) by 0 days.

(21) Appl. No.: 15/713,203

(22) Filed: Sep. 22, 2017

(65) Prior Publication Data

US 2018/0009022 A1 Jan. 11, 2018

Related U.S. Application Data

(63) Continuation of application No. 14/701,154, filed on Apr. 30, 2015.

(Continued)

(51) Int. Cl.

| | |
|---|---|
| ***C22F 1/04*** | (2006.01) |
| ***C22F 1/047*** | (2006.01) |
| ***B65D 1/02*** | (2006.01) |
| ***B21D 51/26*** | (2006.01) |
| ***B21D 51/02*** | (2006.01) |

(Continued)

(52) U.S. Cl.

CPC ..... *B21D 51/02* (2013.01); *B65D 1/0207* (2013.01); *B65D 1/0276* (2013.01); *C22C 21/00* (2013.01); *C22C 21/06* (2013.01); *C22C 21/08* (2013.01); *C22F 1/04* (2013.01); *C22F 1/047* (2013.01)

(58) Field of Classification Search

CPC ..... C22F 1/04; C22F 1/047; B65D 1/0276; B65D 1/0207–1/0284; B21D 51/02

See application file for complete search history.

(56) References Cited

U.S. PATENT DOCUMENTS

| | | | |
|---|---|---|---|
| 872,671 | A | 12/1907 | Nash |
| 1,079,403 | A | 11/1913 | Crecelius |

(Continued)

FOREIGN PATENT DOCUMENTS

| | | | |
|---|---|---|---|
| BE | 376464 | A | 11/1931 |
| BR | 19509811 | A | 10/1997 |

(Continued)

OTHER PUBLICATIONS

International Search Report and Written Opinion, PCT/IB2015/054061, dated Sep. 22, 2015, 12 pages.

(Continued)

*Primary Examiner* — George Wyszomierski
*Assistant Examiner* — Janelle Morillo
(74) *Attorney, Agent, or Firm* — Greenberg Traurig, LLP

(57) ABSTRACT

In some embodiments of present disclosure, a method includes: obtaining an aluminum sheet comprising a 3xxx or a 5xxx alloy having a tensile yield strength as measured in the longitudinal direction of 27-33 ksi and an ultimate tensile strength; wherein the ultimate tensile strength minus the tensile yield strength is less than 3.30 ksi (UTS-TYS<3.30 ksi); and forming a container having a dome from the aluminum sheet.

12 Claims, 9 Drawing Sheets

Related U.S. Application Data

(60) Provisional application No. 61/986,692, filed on Apr. 30, 2014.

(51) Int. Cl.
*C22C 21/08* (2006.01)
*C22C 21/00* (2006.01)
*C22C 21/06* (2006.01)

(56) References Cited

U.S. PATENT DOCUMENTS

| | | | | |
|---|---|---|---|---|
| 1,944,527 | A | 1/1934 | Pfaendler | |
| 2,047,076 | A | 7/1936 | Kronquest | |
| 2,116,199 | A | 5/1938 | Heid | |
| 2,337,616 | A | 12/1943 | McManus et al. | |
| 2,367,300 | A | 1/1945 | McManus et al. | |
| 2,649,999 | A | 8/1953 | Burch | |
| 2,818,990 | A | 1/1958 | Sommerfield | |
| 2,829,802 | A | 4/1958 | Pauli | |
| 2,866,581 | A | 12/1958 | Henchert | |
| 2,965,964 | A | 12/1960 | Loew | |
| 3,164,287 | A | 1/1965 | Williamson | |
| 3,518,339 | A | 6/1970 | Goff | |
| 3,577,753 | A | 5/1971 | Shah et al. | |
| 3,696,657 | A | 10/1972 | Maytag | |
| 3,746,198 | A | 7/1973 | Howland | |
| 3,845,653 | A | 11/1974 | Hilgenbrink | |
| 3,919,871 | A | 11/1975 | Andrasev et al. | |
| 3,924,437 | A | 12/1975 | Hortig | |
| 3,945,231 | A | 3/1976 | Imazu et al. | |
| 3,995,572 | A | 12/1976 | Saunders | |
| 4,148,208 | A | 4/1979 | Maeder | |
| 4,300,375 | A | 11/1981 | Maeder et al. | |
| 4,313,545 | A | 2/1982 | Maeda | |
| 4,431,112 | A | 2/1984 | Yamaguchi | |
| 4,441,354 | A | 4/1984 | Bodega | |
| 4,472,219 | A | 9/1984 | Taira et al. | |
| 4,500,575 | A | 2/1985 | Taira et al. | |
| 4,554,815 | A | 11/1985 | Weishalla | |
| 4,610,366 | A | 9/1986 | Estes et al. | |
| 4,645,544 | A | 2/1987 | Baba et al. | |
| 4,685,322 | A | 8/1987 | Clowes | |
| 4,843,863 | A | 7/1989 | Grims et al. | |
| 4,852,377 | A | 8/1989 | Mikas et al. | |
| 4,929,285 | A | 5/1990 | Zaidi | |
| 4,947,627 | A | 8/1990 | Scheidegger | |
| 4,964,538 | A | 10/1990 | Nimmey et al. | |
| 5,009,901 | A | 4/1991 | Byrne | |
| 5,016,463 | A | 5/1991 | Johansson et al. | |
| 5,168,742 | A | 12/1992 | Heyes et al. | |
| 5,293,765 | A | 3/1994 | Nussbaum-Pogacnik | |
| D346,329 | S | 4/1994 | Biesecker, II | |
| 5,335,532 | A | 8/1994 | Mueller et al. | |
| 5,355,710 | A | 10/1994 | Diekhoff | |
| 5,460,024 | A | 10/1995 | Meneghin et al. | |
| 5,477,722 | A | 12/1995 | Dziedzic et al. | |
| 5,503,689 | A * | 4/1996 | Ward | A47J 36/02 148/437 |
| 5,555,761 | A | 9/1996 | Lavy | |
| 5,557,963 | A | 9/1996 | Diekhoff | |
| 5,704,240 | A | 1/1998 | Jordan | |
| 5,718,352 | A * | 2/1998 | Diekhoff | B21D 51/26 215/44 |
| 5,746,847 | A | 5/1998 | Tanaka et al. | |
| 5,775,160 | A | 7/1998 | Fleischer et al. | |
| 5,778,723 | A | 7/1998 | Diekhoff | |
| 5,822,843 | A | 10/1998 | Diekhoff et al. | |
| 5,978,773 | A | 11/1999 | Hudetz et al. | |
| 6,010,028 | A | 1/2000 | Jordan et al. | |
| 6,199,048 | B1 | 3/2001 | Hudetz et al. | |
| 7,107,804 | B2 | 9/2006 | Gong et al. | |
| 7,337,646 | B2 | 3/2008 | Aoyagi et al. | |
| 7,383,209 | B2 | 6/2008 | Hudetz et al. | |
| D608,204 | S | 1/2010 | Caroen et al. | |
| 7,726,165 | B2 | 6/2010 | Myers et al. | |
| 7,765,126 | B2 | 7/2010 | Hudetz et al. | |
| 7,805,970 | B2 | 10/2010 | Woulds | |
| 7,934,410 | B2 | 5/2011 | Myers et al. | |
| 7,954,354 | B2 | 6/2011 | Myers et al. | |
| 8,131,597 | B2 | 3/2012 | Hudetz et al. | |
| D670,167 | S | 11/2012 | Winter et al. | |
| 8,322,183 | B2 | 12/2012 | Myers et al. | |
| D675,527 | S | 2/2013 | Rogers et al. | |
| 8,511,125 | B2 | 8/2013 | Reimer et al. | |
| D696,116 | S | 12/2013 | Jacober et al. | |
| 8,683,837 | B2 | 4/2014 | Mallory et al. | |
| D722,508 | S | 2/2015 | Hirsberg | |
| D725,471 | S | 3/2015 | Jacober et al. | |
| D725,472 | S | 3/2015 | Jacober et al. | |
| 2003/0046971 | A1 | 3/2003 | Enoki | |
| 2004/0035871 | A1 | 2/2004 | Chupak | |
| 2005/0127077 | A1 | 6/2005 | Chupak | |
| 2012/0043294 | A1 | 2/2012 | Dick et al. | |
| 2012/0227871 | A1 | 9/2012 | Inoue et al. | |
| 2014/0000333 | A1 | 1/2014 | Franham | |
| 2014/0008320 | A1 | 1/2014 | Hosoi | |
| 2014/0298641 | A1 | 10/2014 | Siles et al. | |
| 2015/0314361 | A1 | 11/2015 | Rouns et al. | |
| 2015/0344166 | A1* | 12/2015 | Davis | B65D 1/0246 215/44 |
| 2016/0368650 | A1 | 12/2016 | Davis et al. | |

FOREIGN PATENT DOCUMENTS

| | | | |
|---|---|---|---|
| BR | PI0712097 | A2 | 12/2011 |
| BR | PI0713658 | A2 | 10/2012 |
| BR | PI0713779 | A2 | 10/2012 |
| BR | PI0722419 | A2 | 12/2012 |
| BR | P1072242 | A2 | 11/2013 |
| CA | 2205798 | A1 | 5/1996 |
| CA | 2 602 657 | A1 | 10/2006 |
| CA | 2651778 | A1 | 11/2007 |
| CA | 2655908 | A1 | 1/2008 |
| CA | 2655925 | A1 | 1/2008 |
| CA | 2748426 | A1 | 1/2008 |
| CA | 2807696 | A1 | 2/2012 |
| CA | 2 875 031 | A1 | 12/2013 |
| CN | 101479057 | A | 7/2009 |
| CN | 101479058 | A | 7/2009 |
| CN | 101484256 | A | 7/2009 |
| CN | 101934320 | A | 1/2011 |
| CN | 102581166 | A | 7/2012 |
| EP | 0045115 | A1 | 2/1982 |
| EP | 0053240 | A2 | 6/1982 |
| EP | 0079136 | A1 | 5/1983 |
| EP | 0121620 | A1 | 10/1984 |
| EP | 0402006 | A1 | 12/1990 |
| EP | 0510291 | A1 | 10/1992 |
| EP | 0549987 | A1 | 7/1993 |
| EP | 0667193 | A1 | 8/1995 |
| EP | 1134046 | A1 | 9/2001 |
| EP | 1461262 | A1 | 9/2004 |
| EP | 1914024 | A1 | 4/2008 |
| EP | 1 944 384 | A1 | 7/2008 |
| FR | 633497 | A | 1/1928 |
| FR | 2688431 | A1 | 9/1993 |
| GB | 548274 | A | 10/1942 |
| GB | 2112685 | A | 7/1983 |
| JP | 2009-242830 | | 10/2009 |
| JP | 2009-242831 | | 10/2009 |
| JP | 2011094185 | A * | 5/2011 |
| WO | 2007/136608 | A2 | 11/2007 |
| WO | 2007124792 | A1 | 11/2007 |

OTHER PUBLICATIONS

International Search Report and Written Opinion, PCT/IB2015/054066, dated Sep. 17, 2015, 11 pages.

Ding, et al., "Processing of AA3004 Alloy Can Stock for Optimum Strength and Formability," Metallurgical and Materials Transactions, vol. 28A, Dec. 1997, 7 pages.

(56) References Cited

OTHER PUBLICATIONS

International Search Report and Written Opinion, PCT/US2015/028583, dated Jul. 17, 2015, 3 pages.
International Preliminary Report on Patentability, PCT/IB2015/054066, dated Dec. 15, 2016, 8 pages.
"Ball to Manufacture Reclosable Alumi-Tek (TM) Aluminum Beverage Bottles", Article, PR Newswire, http://www.prnewsire.com/news-releases/ball-to-manufacture-reclosable-akumi-tektm-aluminum-beverage-bottles-56532712.html.
"Tensile Properties and Work Hardening Behavior of Laser-Welded Dual-Phase Steel Joints", N. Farabi, et al., Jun. 27, 2010, Journal of Materials Engineering and Performance, vol. 21(2) Feb. 2012.
"Constitutive Behavior of As-Cast AA1050, AA3104, and AA5182," W.M. Van Haaften, et al., Metallurgical and Materials Transactions A, vol. 33A, Jul. 2012, pp. 1971-1980.
"Alcoa RPD: About Alcoa Rigid Packaging: How aluminum cans are made", http://www.alcoa.com/rigid_packaging/en/info_page/making_cans.asp#.
"Effect of strain rates on tensile and work hardening properties for Al-Zn magnesium alloys" A L Noradila, et al., IOP Conf. Series: Materials Science and Engineering 46 (2013) 012031.
Callister, William D., Jr., "Materials Science and Engineering, an Introduction," 2003, John Wiley & Sons, Inc., Sixth Edition, p. 746.
International Alloy Designations and Chemical Composition Limits for Wrought Aluminum and Wrought Aluminum Alloys,' Unified North American and International Registration Records, The Aluminum Association, p. 1-36, 2004.

* cited by examiner

UTS-TYS in ksi

ALUMINUM SHEET WITH ENHANCED FORMABILITY AND AN ALUMINUM CONTAINER MADE FROM ALUMINUM SHEET

CROSS-REFERENCE TO RELATED APPLICATIONS

This patent application is a continuation of U.S. Non-Provisional patent application Ser. No. 14/701,154 filed Apr. 30, 2015, which claims priority to U.S. Provisional Patent Application No. 61/986,692 filed Apr. 30, 2014, which is incorporated herein by reference in its entirety.

BACKGROUND

In the container industry, substantially identically shaped metal beverage containers are produced massively and relatively economically. In order to expand a diameter of a container to create a shaped container or enlarge the diameter of the entire container, often several operations are required using several different expansion dies to expand each metal container a desired amount. Also, dies have been used to neck and shape the containers. Often several operations are required using several different necking dies to narrow each metal container a desired amount. Open ends of containers are formed by flanging, curling, threading and/or other operations to accept closures. Necking, expanding, shaping, and finishing operations sometimes cause metal failures, such as one or more of the following: curl splits, container fracture, container collapse.

SUMMARY

Referring to FIG. 1, an aluminum sheet 100 comprises a AA 3XXX or a 5xxx alloy having a tensile yield strength (TYS) as measured in the longitudinal direction of 27-33 ksi and an ultimate tensile strength (UTS); wherein the ultimate tensile strength minus the tensile yield strength is less than 3.30 ksi (UTS-TYS<3.30 ksi). In some embodiments, the tensile yield strength as measured in the longitudinal direction is 28-32 ksi. In some embodiments, the tensile yield strength as measured in the longitudinal direction is 28.53-31.14 ksi. In some embodiments, the ultimate tensile strength minus the tensile yield strength is 2.90-3.30 ksi. In some embodiments, the ultimate tensile strength minus the tensile yield strength is 2.99-3.30 ksi. In some embodiments, the aluminum sheet comprises one of AA: 3x03, 3x04 or 3x05. In some embodiments, the aluminum sheet comprises AA 3104. In some embodiments, the aluminum sheet comprises AA 5043. In some embodiments, the ultimate tensile strength is 30-36 ksi. In some embodiments, the ultimate tensile strength is 31-35 ksi. In some embodiments, the ultimate tensile strength is 31.51-34.51 ksi.

In some embodiments, the TYS and (UTS-TYS) values described above are for an aluminum sheet coil "as shipped" to a can maker. The container forming process performed by the can maker includes thermal treatments and mechanical processes, i.e. cold working, both of which affect the TYS and (UTS-TYS) values. The TYS and (UTS-TYS) values of a particular container will vary depending on the thermal treatments and mechanical processes used to form the container and the TYS and (UTS-TYS) values will vary along various points on a single container. For example, sidewalls of a container generally have a lot of cold work, which will result in higher TYS. Heat treatments generally lower TYS. The dome of a container will experience heat treatments but little cold work so the TYS of the dome of a formed container made with sheet described above may be slightly lower than the TYS of the sheet described above.

Referring to FIG. 2, an aluminum container 200 has a dome 210, wherein the dome 210 comprises a AA 3XXX or a 5XXX alloy having a tensile yield strength as measured in the longitudinal direction of 27-33 ksi and an ultimate tensile strength; wherein the ultimate tensile strength minus the tensile yield strength is less than 3.30 ksi (UTS-TYS<3.30 ksi). In some embodiments, the tensile yield strength as measured in the longitudinal direction is 28-32 ksi. In some embodiments, the tensile yield strength as measured in the longitudinal direction is 28.53-31.14 ksi. In some embodiments, the ultimate tensile strength minus the tensile yield strength is 2.90-3.30 ksi. In some embodiments, the ultimate tensile strength minus the tensile yield strength is 2.99-3.30 ksi. In some embodiments, dome 210 comprises one of AA: 3x03, 3x04 or 3x05. In some embodiments, the dome 210 comprises AA 3104. In some embodiments, the dome 210 comprises AA 5043. In some embodiments, the ultimate tensile strength is 30-36 ksi. In some embodiments, the ultimate tensile strength is 31-35 ksi. In some embodiments, the ultimate tensile strength is 31.51-34.51 ksi. In some embodiments, the aluminum container is a bottle. In some embodiments, the aluminum container has been formed by drawing and ironing an aluminum sheet.

Referring to FIG. 3, a method comprises: forming a container 300 from an aluminum sheet comprising a 3XXX or a 5xxx alloy having a tensile yield strength as measured in the longitudinal direction of 27-33 ksi and an ultimate tensile strength; wherein the ultimate tensile strength minus the tensile yield strength is less than 3.30 ksi (UTS-TYS<3.30 ksi); and reducing a diameter of a portion of the container 310 by at least 26%.

Referring to FIG. 4, in some embodiments, reducing a diameter of the container 310 by at least 26% comprises necking the container 320 with necking dies. In some embodiments, reducing the diameter of the container 310 by at least 26% comprises necking the container 320 at least 14 times. In some embodiments, the diameter of the container is reduced by at least 30%.

In some embodiments, the tensile yield strength as measured in the longitudinal direction is 28-32 ksi. In some embodiments, the tensile yield strength as measured in the longitudinal direction is 28.53-31.14 ksi. In some embodiments, the ultimate tensile strength minus the tensile yield strength is 2.90-3.30 ksi. In some embodiments, the ultimate tensile strength minus the tensile yield strength is 2.99-3.30 ksi. In some embodiments, the aluminum sheet comprises one of AA: 3x03, 3x04 or 3x05. In some embodiments, the aluminum sheet comprises AA 3104. In some embodiments, the aluminum sheet comprises AA 5043. In some embodiments, the ultimate tensile strength is 30-36 ksi. In some embodiments, the ultimate tensile strength is 31-35 ksi. In some embodiments, the ultimate tensile strength is 31.51-34.51 ksi.

In some embodiments, the container is a bottle.

Referring to FIG. 5, in some embodiments, the method further comprises expanding a section of the portion of the container having a reduced diameter 330. In some embodiments, the section has a length and the length is at least 0.3 inches. In some embodiments, the length is at least 0.4 inches.

An aluminum sheet is rolled aluminum having a thickness of 0.006 inch to 0.030 inch.

A dome is the dome at the bottom of the container.

A bottle is a rigid container having a neck that is narrower than the body.

The tensile yield strength is defined as the load at 0.2% offset yield divided by the original cross sectional area of the specimen. The ultimate tensile strength is the maximum load divided by the original cross sectional area.

The alloys and tempers mentioned herein are as defined by the American National Standard Alloy and Temper Designation System for Aluminum ANSI H35.1 and "the Aluminum Association International Alloy Designations and Chemical Composition Limits for Wrought Aluminum and Wrought Aluminum Alloys as revised February 2009.

DESCRIPTION

Figure 1:
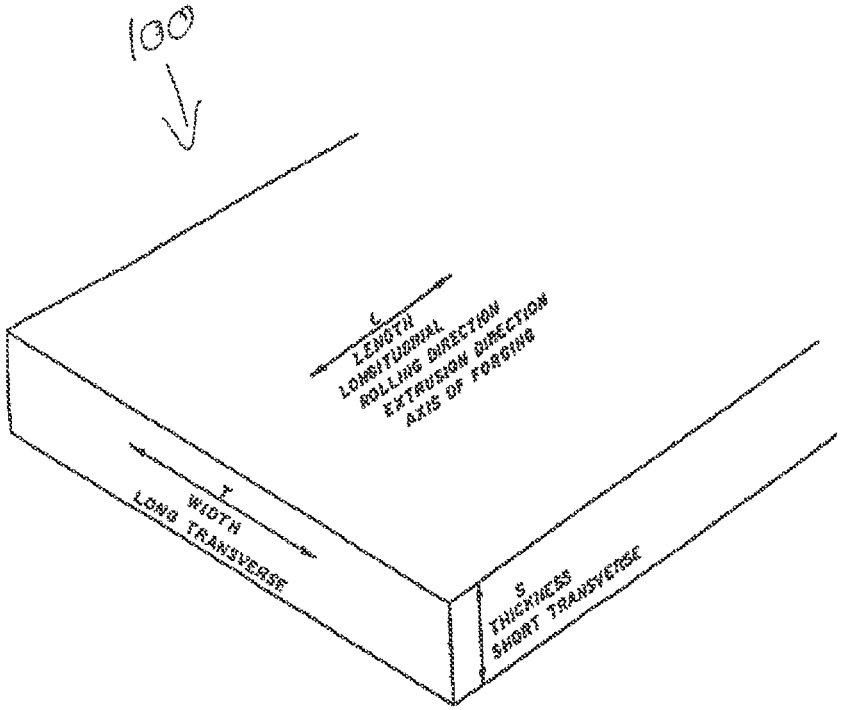
FIG. 1 is a partial enlarged perspective view of an aluminum sheet.
Figure 2:
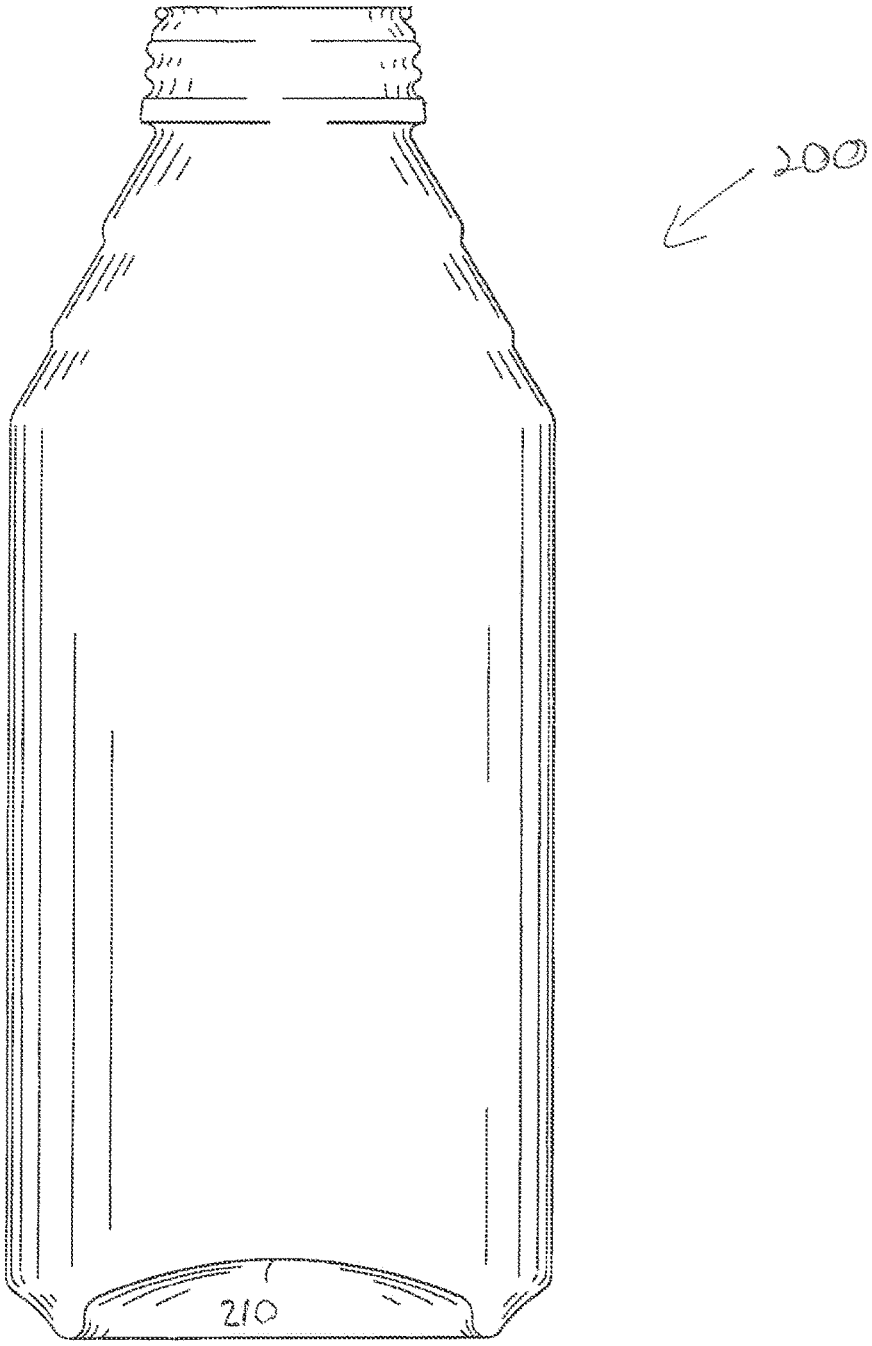
FIG. 2 is a side view of an aluminum bottle having a dome.
Figure 3:
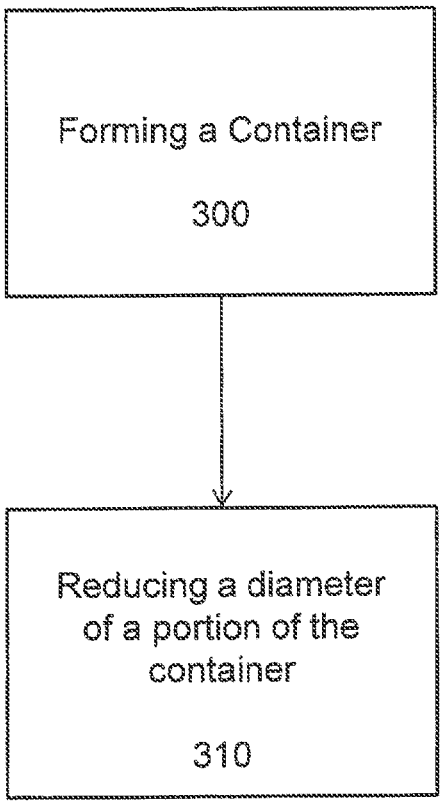
FIG. 3 depicts process steps according to one embodiment.
Figure 4:
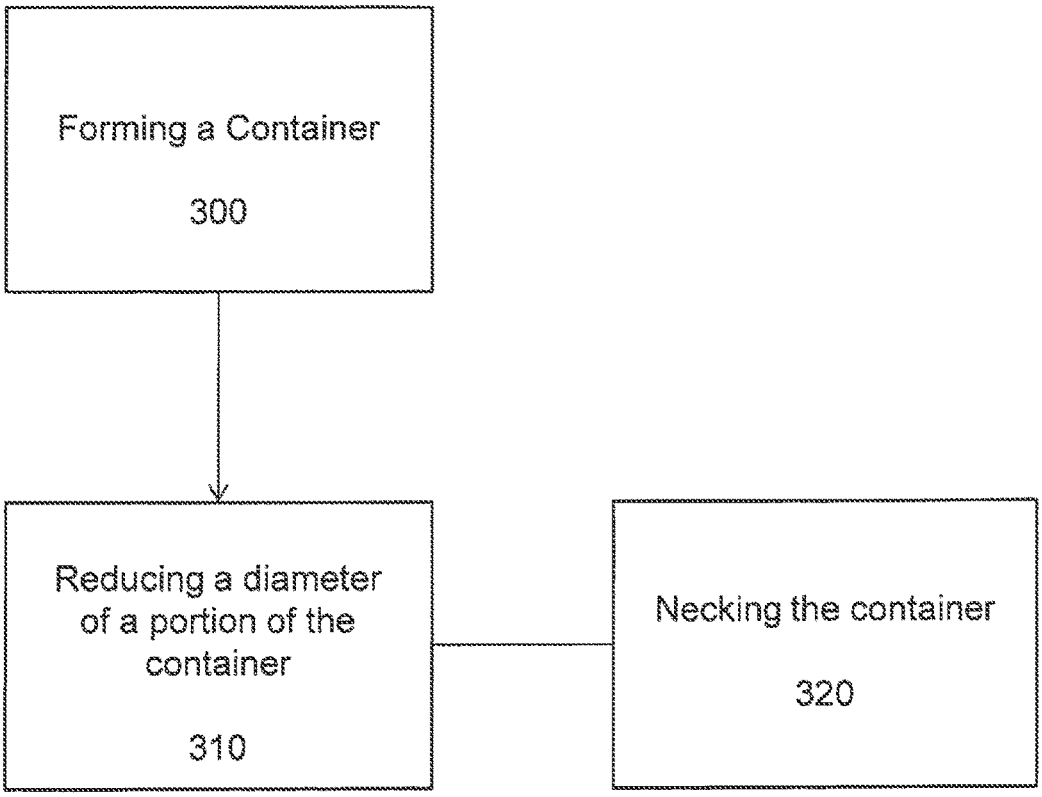
FIG. 4 depicts process steps according to another embodiment.
Figure 5:
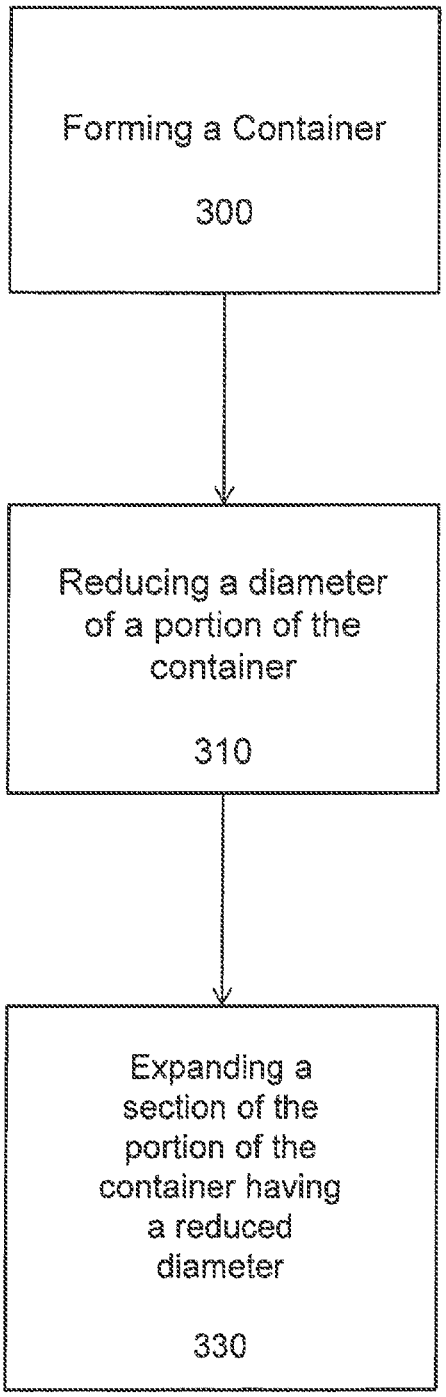
FIG. 5 depicts process steps according to a further embodiment.

The formability of can bottle stock (as measured by reject rate after finishing the opening of the container) has been empirically demonstrated to increase with reduced (<3.30 ksi) UTS-TYS difference. UTS-TYS differences of <3.30 ksi have resulted in less product rejects. Specimens measured were made from finished gauge sheet with a nominal width of ~0.50". The samples were oriented such that the rolling direction is parallel to the applied load.

In some embodiments, finishing comprises one or a combination of the following: forming threads, expanding, narrowing, curling, flanging, or forming the opening of the container to accept a closure. Bottles made from coils of aluminum sheet with UTS-TYS<3.30 ksi have lower reject rates after finishing. Rejection can be caused by container failures, such as one or more of the following: curl splits, container fracture, container collapse. Other types of container failures may cause rejection.

One method to produce reduced UTS-TYS difference bottle stock sheet is a reduction in Ti level and an increase in preheat soak time from standard production targets. In some embodiments, the Ti levels in the aluminum sheet are in the range of 0.0030-0.008 wt %. In some embodiments, the aluminum sheet experiences presoak times in the range of 3 hours at 1080° F. plus 30-40 hours at 1060° F. In some embodiments, the aluminum sheet experiences presoak times in the range of 3 hours at 1080° F. plus 35-40 hours at 1060° F. In some embodiments, the aluminum sheet experiences presoak times in the range of 3 hours at 1080° F. plus 37-40 hours at 1060° F.

Aluminum sheet (10 coils) having an average TYS of ~35.35 ksi (range 34.38-36.18 ksi) with UTS-TYS average of 3.47 ksi (range 3.30-3.80 ksi) are in group 1. The average UTS of group 1 was 38.89 ksi (range 38.09-39.49 ksi). The material in group 1 lacked sufficient formability to be used in the manufacture of bottles.

Coils of aluminum sheets having an average TYS of 32.15 ksi (range 31.00-34.16 ksi) with an average UTS-TYS of 3.42 ksi (range 3.08-3.72 ksi) are in group 2. The average UTS of group 2 was 35.57 ksi (range 34.34-37.49 ksi). The material in group 2 lacked sufficient formability to be used in the manufacture of bottles.

Group 3 coils of aluminum sheet had an average TYS of 30.06 ksi (range 28.97-31.23 ksi) and an average UTS-TYS of 3.36 ksi (range 3.02-3.64 ksi). The average UTS of group 3 was 33.41 ksi (range 31.65-34.81 ksi). Of the group 3 coils some were identified as performing with low bottle reject rates after finishing. Some has sufficient formability to be used in the manufacture of bottles.

Coils of aluminum sheet having an average TYS of 29.83 ksi (28.53-31.14 ksi) and an average UTS-TYS of 3.20 ksi (2.99-3.43 ksi) fall in group 4. The average UTS of group 4 was 33.03 ksi (range 31.54-34.51 ksi). Bottles made from coils of aluminum sheet in group 4 with UTS-TYS<3.30 ksi have low reject rates after finishing.

Figure 6:
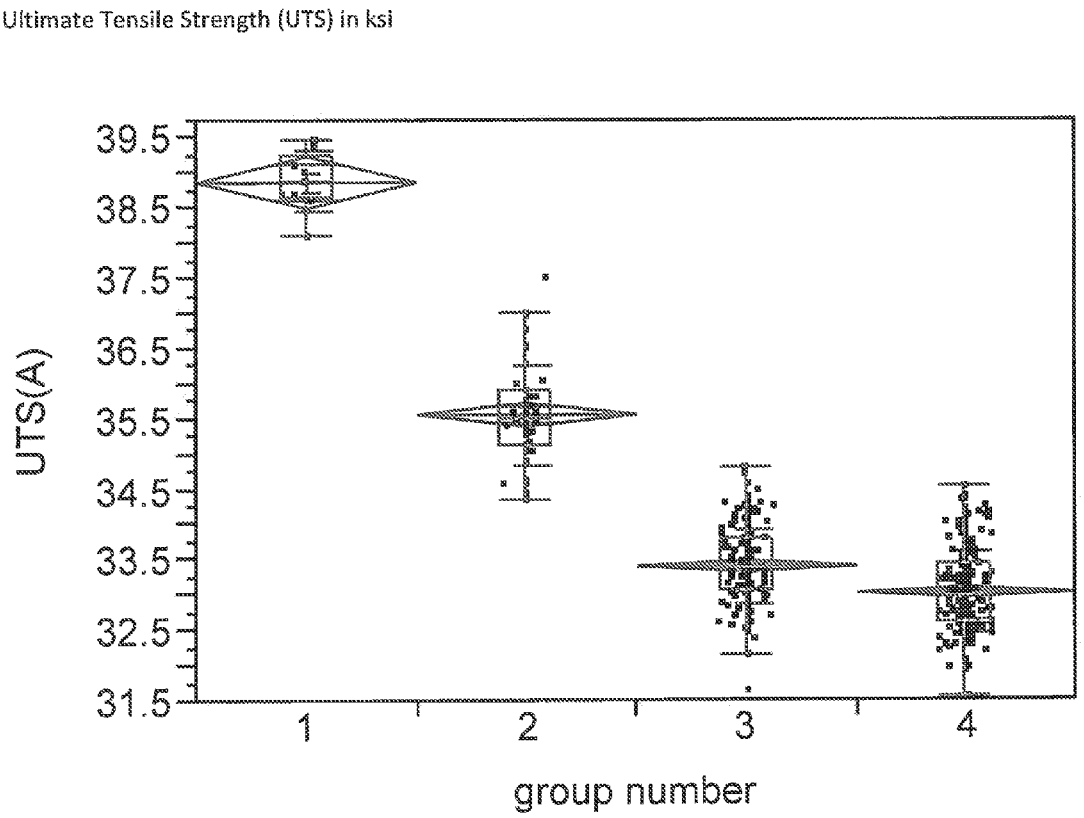
FIG. 6 is a graph illustrating the UTS of groups of coils 1-4.
Figure 7:
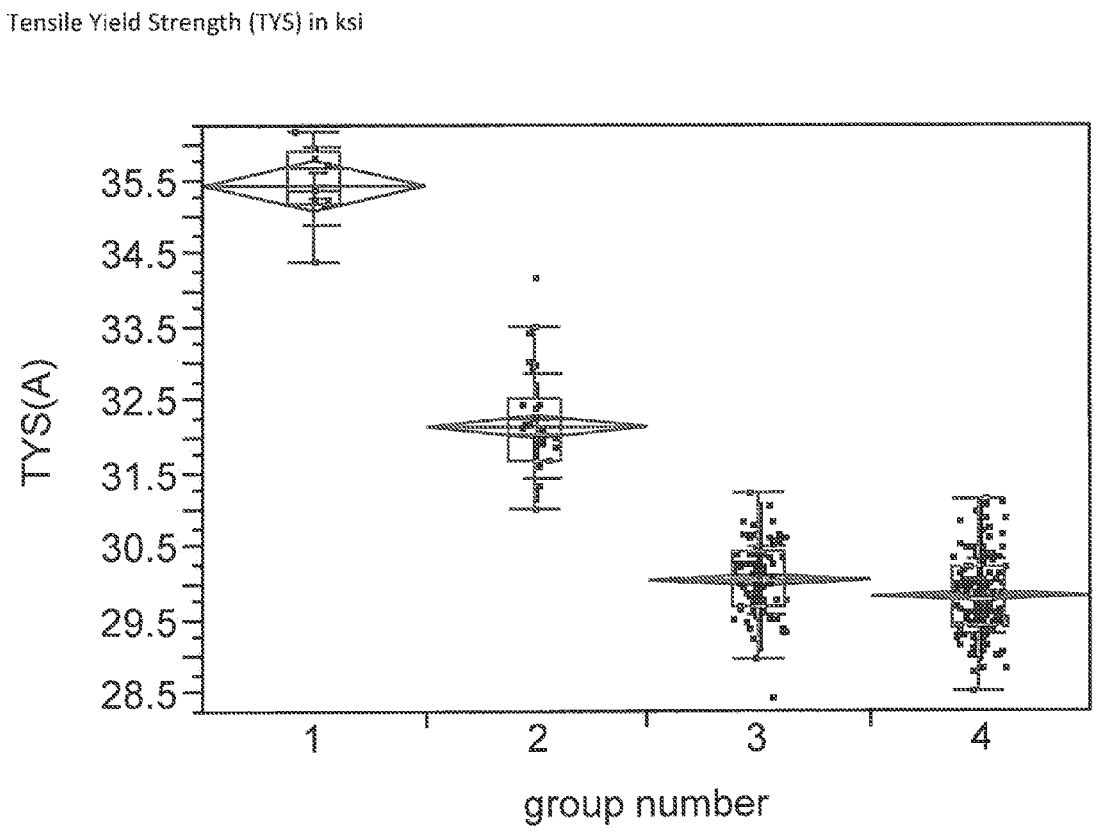
FIG. 7 is a graph illustrating the TYS of groups of coils 1-4.
Figure 8:
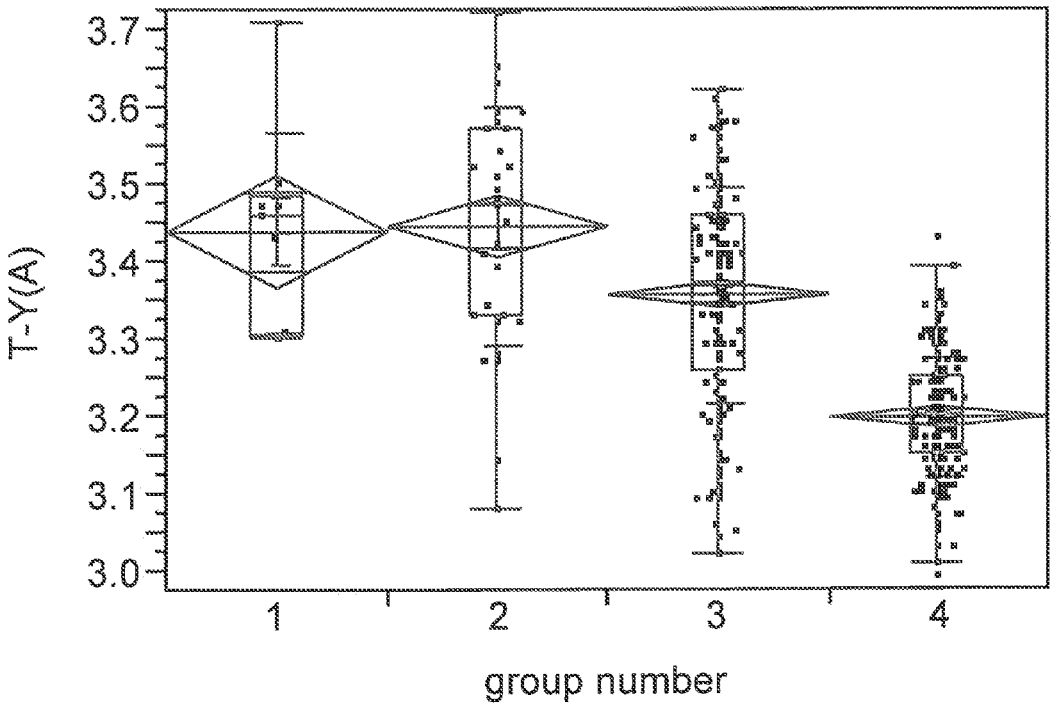
FIG. 8 is a graph illustrating the UTS-TYS of groups of coils 1-4.

The UTS of groups 1-4 is shown in the graph in FIG. 6. The TYS of groups 1-4 is shown in the graph in FIG. 7. The UTS-TYI of groups 1-4 is shown in the graph in FIG. 8.

Figure 9:
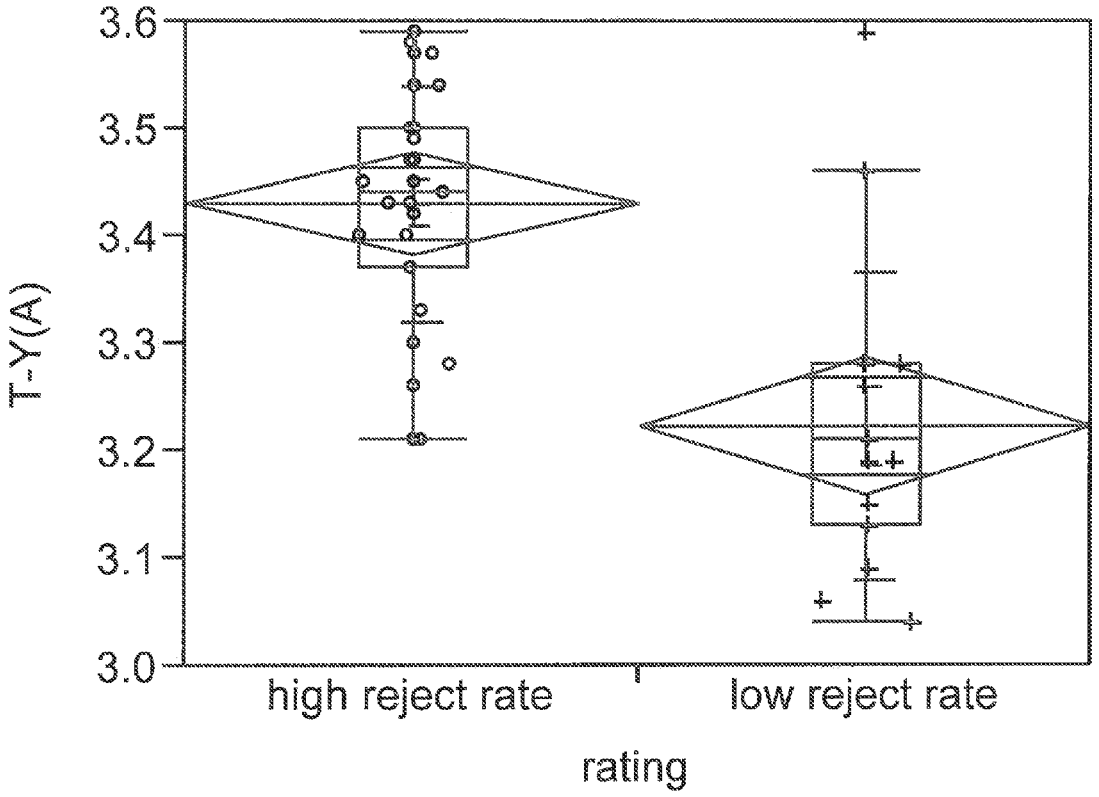
FIG. 9 plots low and high reject rate coils verses UTS-TYS.

The UTS-TYS of a subset of coils from group 3 is plotted against reject rates in FIG. 9. As can be seen in FIG. 9, there is a statistically significant difference in the UTS-TYS for known high reject rate coils and low reject rate coils.

A partition analysis on the reject rate can split the lots into two groups that have the minimal misclassification error at a UTS-TYS value of 3.3. The table below shows the results of the partition analysis of the same data set included in FIG. 9.

| | UTS-TYS < 3.3 | UTS-TYS >= 3.3 |
|---|---|---|
| low reject rate lots | 16 | 2 |
| high reject rate lots | 4 | 21 |

The rate at which the material work hardens is also critical to form a bottle with lower reject rates. Flow stress for aluminum is often defined by a Voce Equation ($\sigma=A-B\exp(-C\varepsilon)$) in which the strain hardening rate is defined by the coefficient "C". Investigation of C values between 5 and 25 resulted in significant bottle forming differences. In some embodiments, a C value in the range of 12-18 can be used to minimize reject rates. In other embodiments a C value in the range of 15-25 can be used. In other embodiments a C value in the range of 20-35 can be used. In other embodiments a C value in the range of 25-50 can be used. In other embodiments a C value in the range of 5-12 can be used.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

The invention claimed is:

1. A method comprising:

obtaining an aluminum sheet comprising a 3xxx or a 5xxx alloy; wherein the aluminum sheet has a tensile yield strength as measured in the longitudinal direction of 27-33 ksi and an ultimate tensile strength; wherein the ultimate tensile strength minus the tensile yield strength is less than 3.30 ksi (UTS-TYS<3.30 ksi); and wherein the aluminum sheet has a thickness of 0.006 inch to 0.030 inch;

drawing and ironing the aluminum sheet to form an aluminum container having a dome;

necking the aluminum container to reduce a diameter of a portion of the aluminum container to form a bottle; and finishing the bottle so as to result in the bottle configured to accept a closure.

2. The method of claim 1, wherein the tensile yield strength as measured in the longitudinal direction is 28-32 ksi.

3. The method of claim 1, wherein the tensile yield strength as measured in the longitudinal direction is 28.53-31.14 ksi.

4. The method of claim 1, wherein the ultimate tensile strength minus the tensile yield strength is 2.90-3.30 ksi.

5. The method of claim 1, wherein the ultimate tensile strength minus the tensile yield strength is 2.99-3.30 ksi.

6. The method of claim 1, wherein the aluminum sheet comprises one of AA: 3x03, 3x04 or 3x05.

7. The method of claim 1, wherein the aluminum sheet comprises AA 3104.

8. The method of claim 1, further comprising expanding a section of the portion of the aluminum container having the reduced diameter.

9. The method of claim 8, wherein the section has a length and the length is at least 0.3 inches.

10. The method of claim 9, wherein the length is at least 0.4 inches.

11. The method of claim 1, wherein the aluminum sheet is a 3xxx alloy.

12. The method of claim 1, wherein the 5xxx alloy is a 5043 alloy.

* * * * *